US010876381B2

(12) United States Patent
Walters et al.

(10) Patent No.: US 10,876,381 B2
(45) Date of Patent: Dec. 29, 2020

(54) DETONATOR ASSEMBLY FOR TRANSPORTABLE WELLBORE PERFORATOR

(71) Applicant: Halliburton Energy Services, Inc., Houston, TX (US)

(72) Inventors: Darren Philip Walters, Tomball, TX (US); Thomas Burky, Mansfield, TX (US); Stuart Michael Wood, Kingwood, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 47 days.

(21) Appl. No.: 16/323,213

(22) PCT Filed: Nov. 14, 2017

(86) PCT No.: PCT/US2017/061523
§ 371 (c)(1),
(2) Date: Feb. 4, 2019

(87) PCT Pub. No.: WO2019/098991
PCT Pub. Date: May 23, 2019

(65) Prior Publication Data
US 2020/0063536 A1 Feb. 27, 2020

(51) Int. Cl.
*E21B 43/1185* (2006.01)

(52) U.S. Cl.
CPC ..... *E21B 43/1185* (2013.01)

(58) Field of Classification Search
CPC ..... E21B 43/11
See application file for complete search history.

(56) References Cited

U.S. PATENT DOCUMENTS 4,850,438 A * 7/1989 Regalbuto ..... E21B 43/117 175/4.56
5,027,708 A 7/1991 Gonzalez et al.
(Continued)

FOREIGN PATENT DOCUMENTS

WO 2015-179787 A1 11/2015

OTHER PUBLICATIONS

International Search Report and Written Opinion dated Aug. 14, 2018; International PCT Application No. PCT/US2017/061523; (12 pages).

(Continued)

*Primary Examiner* — Tara Schimpf
*Assistant Examiner* — Dany E Akakpo
(74) *Attorney, Agent, or Firm* — McGuireWoods LLP

(57) ABSTRACT

The disclosed embodiments include a perforating gun assembly. The perforating gun assembly includes a housing and at least one perforating charge disposed within the housing. Additionally, the perforating gun assembly includes a detonating cord disposed within the housing and ballistically coupled to the at least one perforating charge. Further, the perforating gun assembly includes a first coupling location and a second coupling location that are each configured to couple to an additional perforating gun assembly. A detonator assembly disposed within the first coupling location is also included in the perforating gun assembly. A detonator of the detonator assembly is positioned to fire in a direction away from the detonating cord disposed within the housing.

20 Claims, 4 Drawing Sheets

(56) References Cited

U.S. PATENT DOCUMENTS

| | | | |
|---|---|---|---|
| 5,216,197 | A | 6/1993 | Huber et al. |
| 2009/0084535 | A1 | 4/2009 | Bertoja et al. |
| 2012/0199031 | A1 | 8/2012 | Lanclos |
| 2012/0247771 | A1 | 10/2012 | Black et al. |
| 2015/0376993 | A1 | 12/2015 | Vass et al. |

OTHER PUBLICATIONS

Cohn et al.; "Explosive Trains" Engineering Design Handbook Explosives Series, Mar. 9, 1965; (155 pages).

* cited by examiner

DETONATOR ASSEMBLY FOR TRANSPORTABLE WELLBORE PERFORATOR

BACKGROUND

The present disclosure relates generally to downhole perforating guns used within a well, and more specifically to an arrangement of perforating gun components.

When transporting downhole perforating guns between a gun loading facility and a well site for final use, certain precautions are taken. For example, the downhole perforating guns may include removable ballistic interrupts between detonators and detonator cords of the downhole perforating guns. The removable ballistic interrupt for each perforating gun is manually removed prior to deploying the downhole perforating gun within a well. Further, the ballistic interrupt removal leads to additional operational steps and to manual handling of an armed perforating gun.

Alternatively, detonators may be transported separately from the perforating guns and assembled at the well site. Well site assembly of the perforating gun similarly leads to additional operational steps and to additional manual handling of an armed perforating gun. Further, well site assembly may lead to a reduction in quality of wiring connections of the perforating gun. For example, when the perforating guns are assembled in the field, critical electrical connections have a high likelihood of being damaged or obstructed by field debris.

BRIEF DESCRIPTION OF THE DRAWINGS

Illustrative embodiments of the present disclosure are described in detail below with reference to the attached drawing figures, which are incorporated by reference herein, and wherein.

Figure 1:
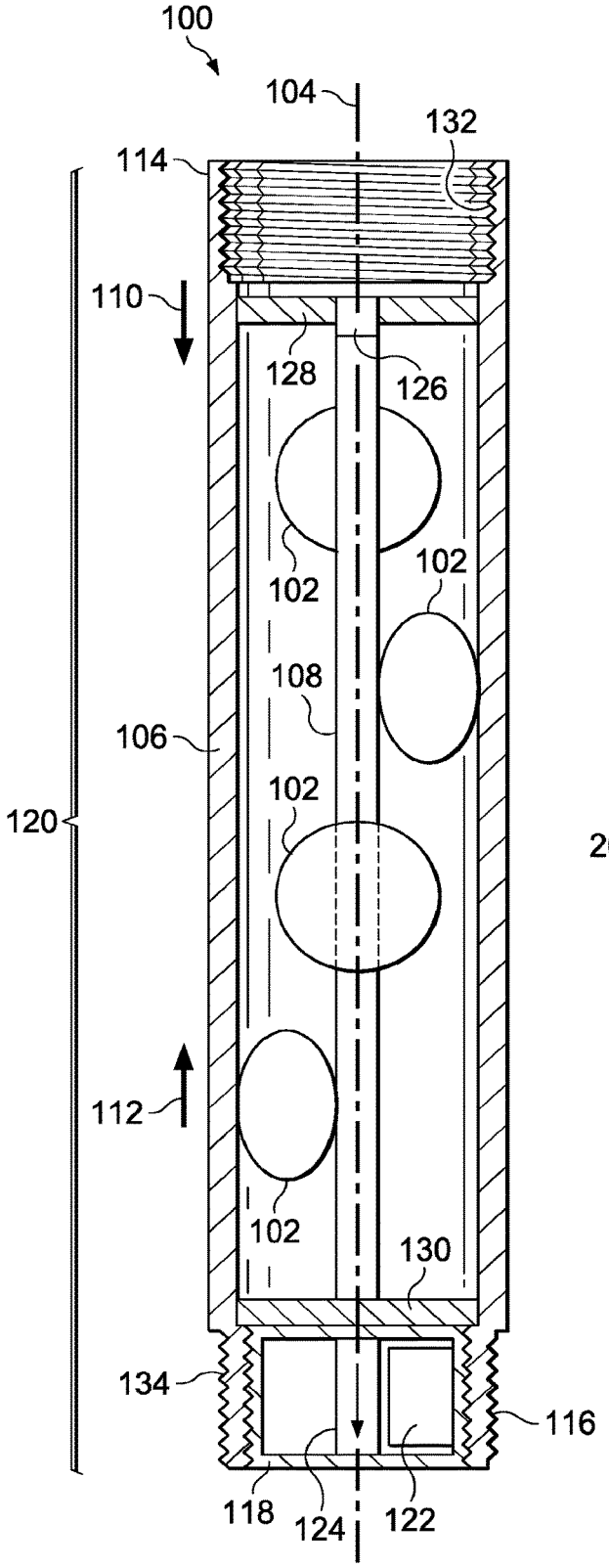
FIG. 1 is a schematic sectional view of a perforating gun assembly including a detonator assembly.

The illustrated figures are only exemplary and are not intended to assert or imply any limitation with regard to the environment, architecture, design, or process in which different embodiments may be implemented.

DETAILED DESCRIPTION

In the following detailed description of the illustrative embodiments, reference is made to the accompanying drawings that form a part hereof. These embodiments are described in sufficient detail to enable those skilled in the art to practice the disclosed subject matter, and it is understood that other embodiments may be utilized and that logical structural, mechanical, electrical, and chemical changes may be made without departing from the spirit or scope of the disclosure. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

As used herein, the singular forms "a", "an" and "the" are intended to include the plural forms as well, unless the context clearly indicates otherwise. It will be further understood that the terms "comprise" and/or "comprising," when used in this specification and/or the claims, specify the presence of stated features, steps, operations, elements, and/or components, but do not preclude the presence or addition of one or more other features, steps, operations, elements, components, and/or groups thereof. In addition, the steps and components described in the above embodiments and figures are merely illustrative and do not imply that any particular step or component is a requirement of a claimed embodiment.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to". Unless otherwise indicated, as used throughout this document, "or" does not require mutual exclusivity.

The present disclosure relates to a perforating gun that punches holes in a casing at a downhole location. More particularly, the present disclosure relates to an arrangement of components of the perforating gun that enables transport of the perforating gun while the detonator assembly is attached and reduces manual handling of armed perforating guns. The presently disclosed embodiments may be used in horizontal, vertical, deviated, or otherwise nonlinear wellbores in any type of subterranean formation. Embodiments may be implemented in completions operations to perforate a casing prior to production.

Referring to FIG. 1, a schematic sectional view of a perforating gun assembly 100 is provided. The perforating gun assembly 100 includes a plurality of charges 102 that are aimed in various directions radially outward from a longitudinal axis 104 of the perforating gun assembly 100. In other embodiments, the plurality of charges 102 may all be aimed in a single direction facing radially outward from the longitudinal axis 104. The charges 102 include a small amount of high explosive that is shaped to produce a pressure punch capable of punching holes in a casing within a well. In an embodiment, the pressure punch is capable of punching holes in steel, cement, rock formations, or any other surfaces that the pressure punch of the charges 102 may come in contact with in a downhole well. The perforating gun assembly 100 also includes a housing 106 that provides structural support to the perforating gun assembly 100. The housing 106 houses detonating cord 108 located within the perforating gun assembly 100 ballistically coupled to the charges 102 to detonate the charges 102.

The perforating gun assembly 100, as illustrated in FIG. 1, is fired in a top down manner, as indicated by arrow 110. In an additional or alternative embodiment, the perforating gun assembly 100 may be flipped vertically to fire in a bottom up manner, as indicated by arrow 112. Top down fire (e.g., in the direction of the arrow 110) of the perforating gun assembly 100 is used to have a detonation wave move from an uphole coupling 114 to a downhole coupling 116 of the perforating gun assembly 100. This configuration reduces wire feed length through the perforating gun assembly 100.

Bottom up firing of the perforating gun assembly 100 is used to have a detonation wave move from the downhole coupling 116 to the uphole coupling 114 of the perforating gun assembly 100. In either embodiment, the operator is afforded the ability to select fire each section 120 of the perforating gun assembly 100 in an order moving from a furthest downhole section 120 of the perforating gun assembly 100 to the most uphole section 120 of the perforating gun assembly 100 on command.

The perforating gun assembly 100 illustrated in FIG. 1 depicts the perforating gun 100 in an assembled travelling state. That is, the perforating gun assembly 100 is illustrated in a state that is capable of transport with a detonator assembly 118 loaded within the downhole coupling 116. The detonator assembly 118 is positioned in such a manner to provide the detonating force to a section 120 of the perforating gun assembly 100 positioned in a downhole location from the illustrated section 120 of the perforating gun assembly 100. In a bottom up firing configuration, the perforating gun assembly 100 is flipped vertically, and the detonator assembly 118 is positioned in such a manner to provide the detonating force to the section 120 of the perforating gun assembly positioned in an uphole location from the illustrated section 120 of the perforating gun assembly 100.

The detonator assembly 118 includes a detonator control board 122 and a detonator 124. The detonator control board 122 controls firing of the detonator 124 based on control signals received from the surface of the well. The detonator 124 is aligned in a direction that fires away from the detonating cord 108 of the section 120 in which the detonator assembly 118 is installed. Additionally, the detonator 124 is separated from the detonating cord 108 by an impenetrable ballistic bulkhead 130. In this manner, even if the detonator 124 inadvertently fires while installed within the section 120 of the perforating gun assembly 100, the detonator 124 is not aligned with a section of the detonator cord 108 within the section 120 in which the detonator assembly 118 is installed. Thus, individual sections 120 of the perforating gun assembly 100 are transportable while the detonator assembly 118 is installed within the individual sections 120 without a threat of an inadvertent firing of the charges 102. While the present application generally refers to the detonator 124 as a detonator, in an embodiment, the detonator 124 may be replaced by an igniter. An igniter is fired by a similar electrical signal as the detonator 124, but the igniter is designed to initiate a burn of a gas generator pellet contained in a setting tool located at a downhole end of a string of the sections 120 of the perforating gun assembly 100. In this manner, the setting tool may be used to set a variety of plugs or other devices immediately prior to commencement of perforating operations. The igniter may be located at a downhole end of the sections 120, as illustrated with the detonator 124, or the igniter may be placed in an extension threaded into a downhole end of the perforating gun assembly 100 that couples to the setting tool.

When an additional section 120 is coupled to the illustrated section 120 either downhole or uphole from the illustrated section 120 of the perforating gun assembly 100, a booster 126 aligning with the detonating cord 108 is also aligned with the detonator 124 of the additional section 120. When the booster 126 of the illustrated section 120 aligns with the detonator 124 of the additional section 120, the charges 102 of the illustrated section 120 are in a configuration capable of firing upon detonation of the detonator 124. To help align components of the different sections 120 in a precise manner, the booster 126 may be centered within a charge string alignment bulkhead 128. In other embodiments, the booster 126 may be off center as long as the detonator 124 aligns with the booster 126 once connected to transfer the ballistic wave to the detonating cord 108. The charge string alignment bulkhead 128 positions the booster 126 directly in-line with a detonator 124 of a detonator assembly 118 when multiple sections 120 of the perforating gun assembly 120 are strung together. Additionally, the booster 126 is aligned with the detonating cord 108 of the individual section 120 in which the booster 126 is positioned. Adjacent to the downhole coupling 116, a bulkhead 130 is provided within the housing 106 of the perforating gun assembly 100. The bulkhead 130 provides a ballistic interrupt between the detonating cord 108 and the detonator assembly 118. Further, the sections 120 of the perforating gun assembly 100 may be coupled together using female threads 132 at the uphole coupling 114 and corresponding male threads 134 of the downhole coupling 116. Any other coupling hardware or configuration suitable to couple the sections 120 are also contemplated within the scope of the presently disclosed subject matter.

Figure 2:
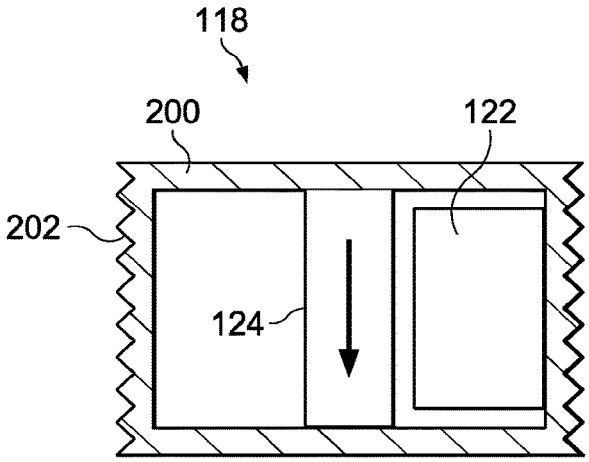
FIG. 2 is a schematic sectional view of the detonator assembly of FIG. 1.

FIG. 2 is a schematic sectional view of the detonator assembly 118. The detonator assembly 118 includes a housing 200 with threading 202 on an outer edge of the housing 200. The threading 202 enables installation and removal of the detonator assembly 118 to and from the perforating gun assembly 100. Other securement methods of the detonator assembly 118 that sufficiently retain the detonator assembly 118 within the section 120 of the perforating gun assembly 100 are also contemplated within the scope of the present disclosure. A section 120 of the perforating gun assembly 100 that is positioned furthest uphole within a wellbore in a top down firing configuration or furthest downhole in a bottom up firing configuration includes an additional detonator assembly 118 that begins firing of the charges 102 of the initial section 120 of the perforating gun assembly 100. This detonator assembly 118 receives the initial control signal at the control board 122 and provides the instructions to fire the detonator 124.

In an embodiment, the detonator assembly 118 added to the furthest uphole or furthest downhole section 120 may be the detonator assembly 118 that is shipped with the section 120 positioned at an opposite end of the perforating gun assembly 100. Once the individual sections 120 reach the well site, the section 120 installed at an end of the charge string includes a detonator assembly 118 that is not positioned to fire at a booster 126 of a subsequent section 120. In such an embodiment, the detonator assembly 118 of the section 120 installed at the end of the perforating gun assembly 100 is removed and placed in a first section 120 of the charge string in-line with the booster 126 of the first section 120 of the perforating gun assembly 100. In another embodiment, a number of the detonator assemblies 118 or igniter assemblies may be purchased and/or shipped separately from the assembled sections 120, and the separate detonator assemblies 118 are installed on an initial section 120 of the perforating gun assembly 100 as the perforating gun assembly 100 is assembled for deployment into the well.

Figure 3:
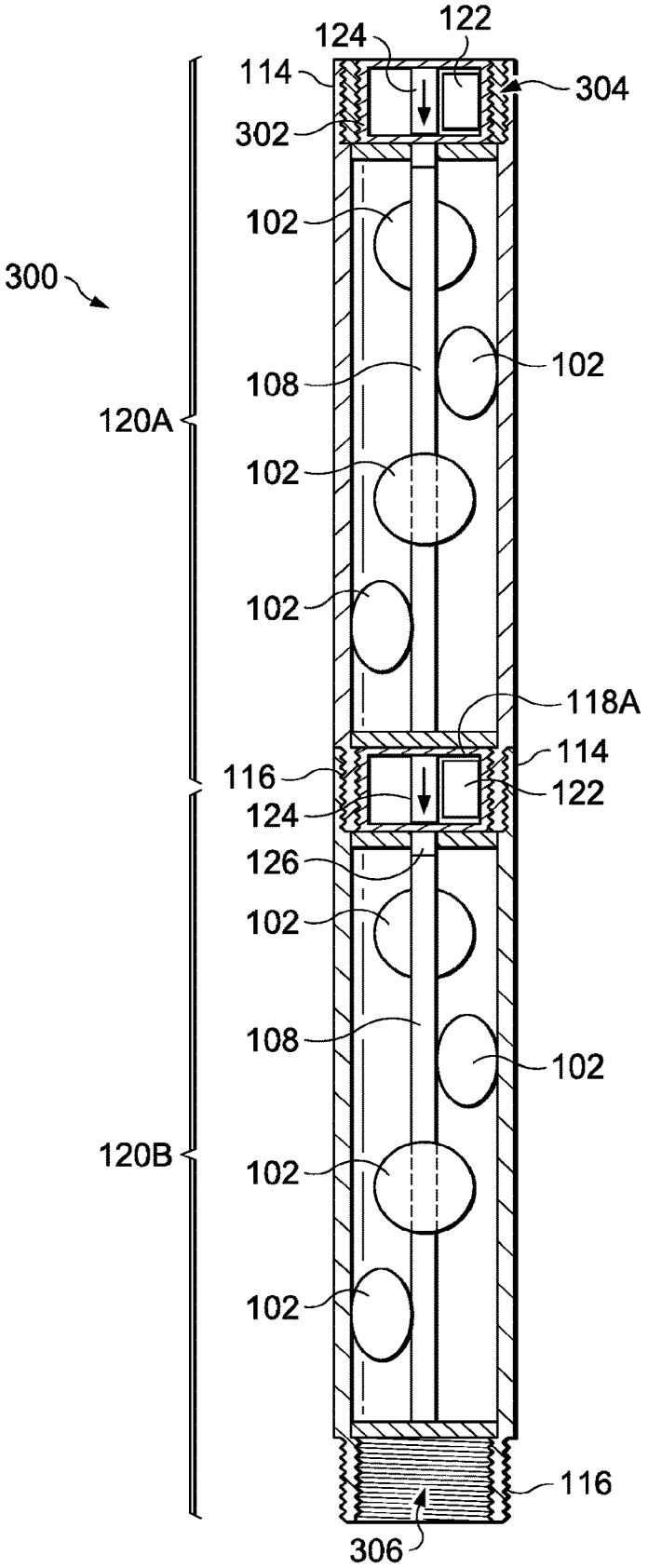
FIG. 3 is a schematic sectional view of an extended perforating gun assembly.

Turning to FIG. 3, a schematic sectional view of an extended perforating gun assembly 300 is depicted. The extended perforating gun assembly 300 includes a first section 120A and a second section 120B. While only the two sections 120A and 120B are illustrated, more sections are also contemplated to make up the extended perforating gun assembly 300. For example, the extended perforating gun assembly 300 may, in an embodiment, include up to ten or more sections 120. Each of the sections 120A and 120B may include between one and twenty or more charges 102.

The extended perforating gun assembly 300 includes multiple sections 120 (e.g., the sections 120A and 120B) coupled end over end. For example, each of the sections 120 include an uphole coupling 114 and a downhole coupling 116. The uphole coupling 114 of one section 120 couples to a downhole coupling 116 of a different section 120. Accordingly, the extended perforating gun assembly 300 is customizable based on a number of charges 102 desired at a downhole location within the wellbore and/or a number of locations or zones within the wellbore where perforations are desired. In an embodiment, each of the sections 120 include a detonator assembly 118 and/or 302 that detonates the detonating cord 108 of an individual section 120.

The detonator assemblies 118 and 302 may be radio frequency (RF) safe detonators. That is, the detonator assemblies 118 and 302 may operate in a fail-safe manner around devices operating using radio frequency communications. For example, operators at a surface of a well may communicate over radio frequency channels to coordinate activity at a wellsite. Because the detonator assemblies 118 and 302 are RF safe detonators, the operators may continue to communicate over the radio frequency channels while the detonator assemblies 118 and 302 are positioned within the extended perforating gun assembly 300 prior to deployment downhole within the well.

In addition to being RF safe detonators, the detonator assembly 118A may be shipped while assembled within the section 120A. As discussed in detail above with respect to FIG. 1, the detonator assembly 118A detonates in a direction away from the detonating cord 108 of the section 120A. In this manner, the section 120A of the extended perforating gun assembly 300 is transportable to a well site while the detonator assembly 118A is installed within the section 120A.

A detonator assembly 302 is installed within a receiving port 304 of the section 120A. In an embodiment, the detonator assembly 302 is removable from a detonator assembly port 306 of the section 120B for installation in the receiving port 304. In this manner, a number of sections 120 used for the extended perforating gun assembly 300 may be transported with the detonator assemblies 118/302 installed within the sections 120 without relying on additional detonator assemblies 118/302 (e.g., detonator assemblies 118/302 shipped apart from an assembled section 120) that are placed at the receiving port 304 to commence firing of the extended perforating gun assembly 300.

Figure 4:
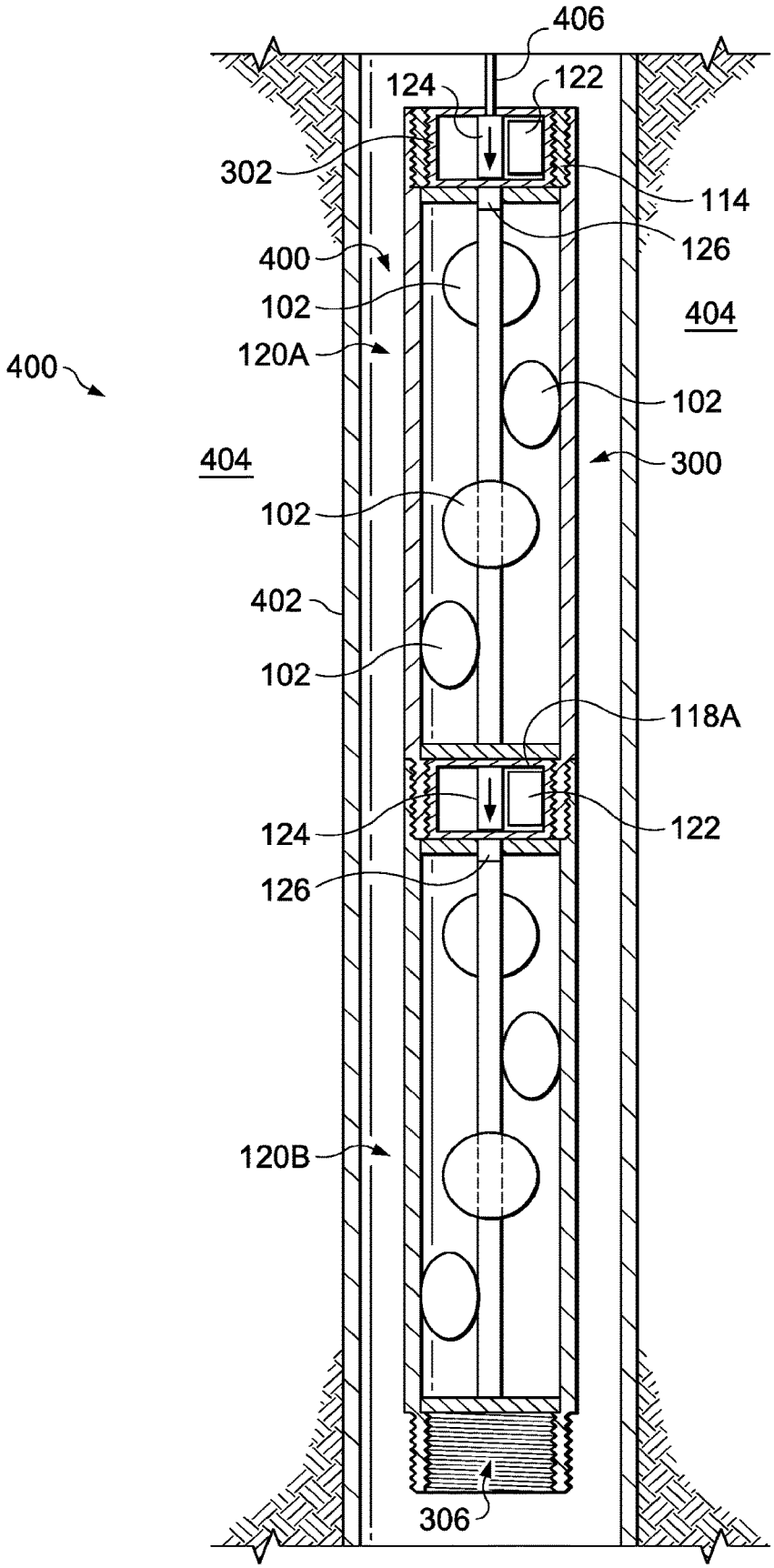
FIG. 4 is a schematic sectional view of the extended perforating gun assembly of FIG. 3 positioned within a wellbore in a top down fire configuration.

FIG. 4 is a schematic sectional view of the extended perforating gun assembly 300 positioned within a wellbore 400 in a top down fire configuration. The extended perforating gun assembly 300 is positioned within a wellbore casing 402. In an embodiment, the charges 102 of the perforating gun assembly 100 are positioned in close proximity with the wellbore casing 402 such that the charges 102 punch holes in the wellbore casing 402 when fired. The positioning of the charges 102 in relation to the wellbore casing 402 may be such that when the charges 102 punch through the wellbore casing 402, effective flow communication is provided between the wellbore 200 and a geological formation 404. As used herein, the term "close proximity" means that the charges 102 are positioned closer to the wellbore casing 402 than seventy-five percent of a diameter of the wellbore casing 402.

The extended perforating gun assembly 300 may be fed into the wellbore 400 using a wireline 406. In some embodiments, the wireline 406 may be replaced with a slickline, or the extended perforating gun assembly 300 may be conveyed by pipe. In an embodiment, the wireline 406 provides a signal to the detonator assemblies 118A and 302 assembled within the extended perforating gun assembly 300. Upon receiving a detonate signal from the wireline 406, the detonator assemblies 118A and/or 302 detonate the boosters 126 resulting in detonation of the detonating cord 108. The detonating cord 108 detonates the charges 102 of the extended perforating gun assembly 300 to punch the wellbore casing 402.

The top down fire configuration of the extended perforating gun assembly 300 may be used for extended perforating gun assemblies 300 that fire each of the sections 120A, 120B, and any additional sections 120 simultaneously. That is, all of the sections 120A, 120B, or any additional sections 120 of the extended perforating gun assembly 300 are fired at the same time when the control boards 122 of the detonator assemblies 118A, 302, or any additional detonator assemblies 118 receive a fire signal. As illustrated, the fire signal may originate from the wireline 406 that is used to run the extended perforating gun assembly 300 downhole within the wellbore 400. Other signal control lines are also contemplated to provide the fire signal to the detonator assemblies 118A, 302, or any additional detonator assemblies 118.

In another embodiment, the top down fire configuration of the extended perforating gun assembly 300 may be used in a select fire operation. That is, the top down fire configuration may be used when select firing of individual sections 120A or 120B is desired. In such an embodiment, the wireline 406, or any other adequate signal control line, provides the fire signal to each of the sections 120 individually rather than all of the sections 120 at the same time.

In a select fire embodiment of the top down fire configuration, the wireline 406 or signal control line extends a length of the extended perforating gun assembly 300 to a detonator assembly 118 positioned in-line with a furthest downhole section 120 of the extended perforating gun assembly 300 (e.g., 120B in the illustrated embodiment). Each of the detonator assemblies 118 and 302 may be individually addressable such that the detonators 124 are fired using different signals provided to each of the detonator assemblies 118 and 302. For example, each of the detonator assemblies 118 and 302 may include separate IP addresses for communication with a surface of the well. Therefore, an operator at the surface of the well may instruct the individual sections 120A and 120B to fire the charges 102 independently of the other individual sections 120A and 120B. This enables a single extended perforating gun assembly 300 to perforate the casing 402 at a number of different locations or zones within the wellbore 400.

Figure 5:
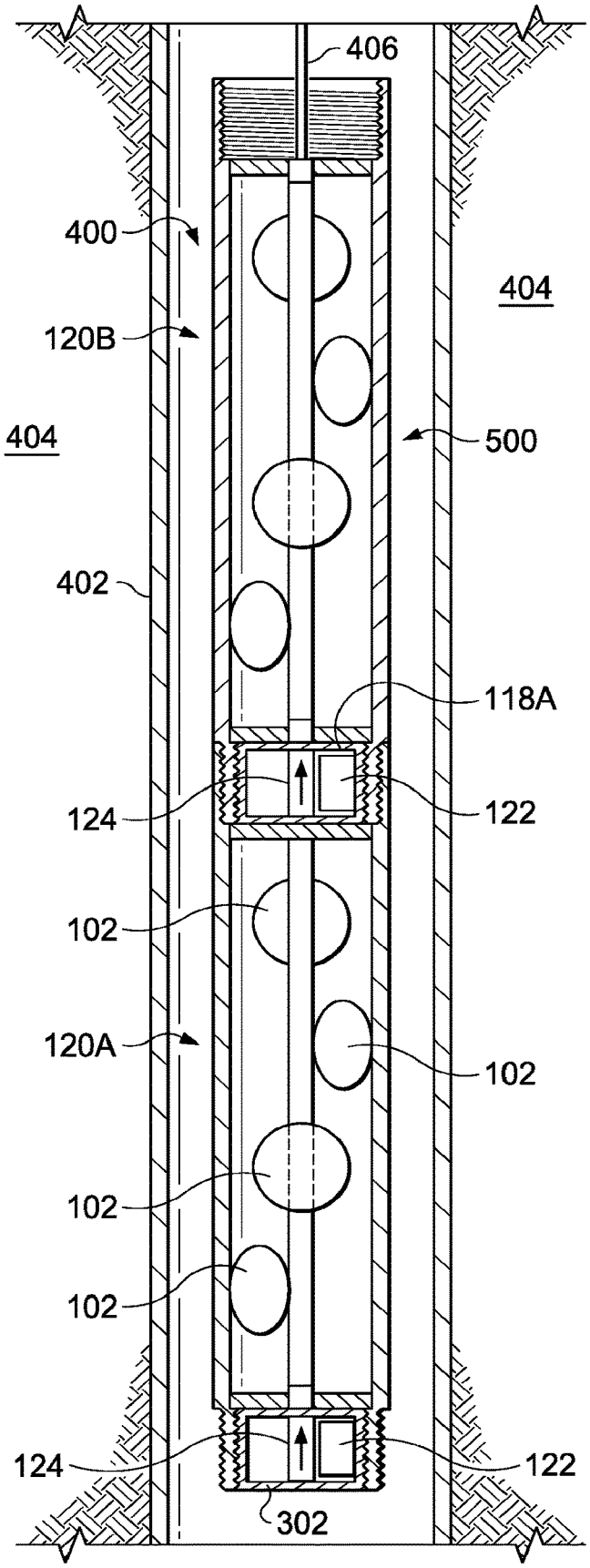
FIG. 5 is a schematic sectional view of the extended perforating gun assembly of FIG. 3 positioned within a wellbore in a bottom up fire configuration.

FIG. 5 is a schematic sectional view of an extended perforating gun assembly 500 positioned within the wellbore 400 in a bottom up fire configuration. In the bottom up fire configuration of the extended perforating gun assembly 500, the extended perforating gun assembly 500 is deployed within the wellbore 400 to punch holes in the casing 402 and/or the geological formation 404 surrounding the wellbore 400. The bottom up fire configuration may be used for the extended perforating gun assemblies 500 that fire each of the sections 120A, 120B, and any additional sections 120 with a select fire arrangement. That is, the bottom up fire configuration may be used when select firing of individual sections 120A or 120B is desired. In such an embodiment, the wireline 406, or any other adequate signal transmission component, provides the fire signal to each of the sections 120 individually rather than to all of the sections 120 at the same time. In an embodiment, the bottom up fire configuration is generally the extended perforating gun assembly 300 in an inverted arrangement. For example, the section 120A is the furthest downhole section 120 in the extended perforating gun assembly 500 and the section 120B is the furthest uphole section 120 in the extended perforating gun assembly 500.

In the select fire embodiment of the bottom up fire configuration, the wireline 406 or another control wire may extend a length of the extended perforating gun assembly 500 to a detonator assembly 118 positioned in-line with a furthest downhole section 120 (e.g., 120A in the illustrated embodiment). Each of the detonator assemblies 118 and 302 may be individually addressable such that the detonators 124 are fired using different signals provided to each of the detonator assemblies 118 and 302. Therefore, an operator at a surface of the well may instruct the individual sections 120A and 120B to fire the charges 102 independently of the other individual sections 120A and 120B. This enables a single extended perforating gun assembly 500 to perforate the casing 402 at a number of different locations or zones within the wellbore 400.

Another embodiment of the select fire arrangement in the bottom up fire configuration of the extended perforating gun assembly 500 uses non-addressable detonators 124. In such an embodiment, the furthest downhole detonator assembly 118 or 302 (e.g., detonator assembly 302 in the illustrated embodiment) is activated upon insertion of the extended perforating gun assembly 500 within the wellbore 400. The remaining detonator assemblies 118 or 302 of the extended perforating gun assembly 500 remain in an inactive state. For example, the control boards 122 of the remaining detonator assemblies 118 and 302 are not coupled to a signal line that provides the fire signal to the detonator assemblies 118 and 302. Upon firing the furthest downhole section 120 (e.g., the section 120A in the illustrated embodiment), the percussion of the section 120A results in the bulkhead 130 of the section 120A triggering a mechanical switch at the next detonator assembly 118 or 302 (e.g., the detonator assembly 118A in the illustrated embodiment). Triggering the mechanical switch couples the control board 122 to the signal line that provides the fire signal to the detonator assembly 118A. This process is repeated as each individual section 120 is fired until firing of the final section 120 of the extended perforating gun assembly 500 (e.g., the section 120B in the illustrated embodiment).

In another embodiment, each of the sections 120A and 120B of the extended perforating gun assembly 500 are fired simultaneously. That is, all of the sections 120A, 120B, or any additional sections 120 of the extended perforating gun assembly 500 are fired simultaneously when the control boards 122 of the detonator assemblies 118A, 302, or any additional detonator assemblies 118 receive a fire signal. In such an embodiment, the fire signal at each of the control boards 122 will be the same. As illustrated, the fire signal may originate from the wireline 406 that is used to run the extended perforating gun assembly 500 downhole within the wellbore 400. Other signal transmission configurations are also contemplated to provide the fire signal to the detonator assemblies 118A, 302, or any additional detonator assemblies 118.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. The scope of the claims is intended to broadly cover the disclosed embodiments and any such modification. Further, the following clauses represent additional embodiments of the disclosure and should be considered within the scope of the disclosure:

Clause 1, a perforating gun assembly, comprising: a housing; at least one perforating charge disposed within the housing; a detonating cord disposed within the housing and ballistically coupled to the at least one perforating charge; a first coupling location and a second coupling location each configured to couple to an additional perforating gun assembly; and a detonator assembly disposed within the first coupling location, wherein a detonator of the detonator assembly is positioned to fire in a direction away from the detonating cord disposed within the housing.

Clause 2, the assembly of clause 1, wherein the detonator assembly comprises a detonator control board, and wherein the detonator control board is configured to receive a firing signal and control firing of the detonator.

Clause 3, the assembly of clause 1, wherein the detonator assembly is configured to detonate a second detonating cord of a second perforating gun assembly coupled to the perforating gun assembly.

Clause 4, the assembly of at least one of clauses 1-3, comprising a booster coupled to the detonating cord adjacent to the second coupling location.

Clause 5, the assembly of at least one of clauses 1-4, comprising a second detonator assembly disposed within the second coupling location.

Clause 6, the assembly of clause 5, wherein the second detonator assembly is disposed within a second perforating gun assembly.

Clause 7, the assembly of at least one of clauses 1-6, wherein the at least one perforating charge is configured to punch holes in a casing of a wellbore.

Clause 8, the assembly of at least one of clauses 1-7, wherein the detonator assembly is individually addressable.

Clause 9, the assembly of at least one of clauses 1-8, wherein the detonator assembly is non-addressable.

Clause 10, the assembly of at least one of clauses 1-9, wherein the detonator assembly is secured within the first coupling location using a threaded connection.

Clause 11, an extended perforating gun assembly, comprising: a first perforating gun section, comprising: a first housing; a first set of one or more perforating charges disposed within the first housing; a first detonating cord disposed within the first housing and ballistically coupled to the first set of the one or more perforating charges; a first coupling location and a second coupling location; a first detonator assembly disposed within the first coupling location, wherein a first detonator of the first detonator assembly is configured to detonate the first detonating cord; and a second detonator assembly disposed within the second coupling location, wherein a second detonator of the second detonator assembly is positioned to fire in a direction away from the first detonating cord disposed within the first housing; and a second perforating gun section, comprising: a second housing; a second set of the one or more perforating charges disposed within the second housing; a second detonating cord disposed within the second housing and ballistically coupled to the second set of the one or more perforating charges, wherein the second detonator of the second detonator assembly is configured to detonate the second detonating cord; and a third coupling location and a fourth coupling location, wherein the third coupling location is coupled to the second coupling location of the first perforating gun section.

Clause 12, the assembly of clause 11, comprising a third detonator assembly disposed within the fourth coupling location of the second perforating gun section.

Clause 13, the assembly of clause 11 or 12, wherein the first detonator assembly is further downhole than the second detonator assembly when the extended perforating gun assembly is deployed within a wellbore.

Clause 14, the assembly of at least one of clauses 11-13, wherein the first detonator assembly is further uphole than the second detonator assembly when the extended perforating gun assembly is deployed within a wellbore.

Clause 15, the assembly of at least one of clauses 11-14, wherein the first detonator assembly and the second detonator assembly are individually addressable by control signals.

Clause 16, the assembly of at least one of clauses 11-15, wherein the first detonator assembly is non-addressable.

Clause 17, an extended perforating gun assembly, comprising: a first perforating gun section, comprising: a first housing; a first set of one or more perforating charges disposed within the first housing; a first detonating cord disposed within the first housing and ballistically coupled to the first set of the one or more perforating charges; a first coupling location and a second coupling location; and a first detonator assembly disposed within the first coupling location, wherein a first detonator of the first detonator assembly is positioned to fire in a direction away from the first detonating cord disposed within the first housing; and a second perforating gun section, comprising: a second housing; a second set of the one or more perforating charges disposed within the second housing; a second detonating cord disposed within the second housing and ballistically coupled to the second set of the one or more perforating charges, wherein the first detonator of the first detonator assembly is configured to detonate the second detonating cord; a third coupling location and a fourth coupling location, wherein the fourth coupling location is coupled to the first coupling location of the first perforating gun section; and a second detonator assembly disposed within the third coupling location, wherein a second detonator of the second detonator assembly is positioned to fire in a direction away from the second detonating cord disposed within the second housing.

Clause 18, the assembly of clause 17, comprising: a third perforating gun section, comprising: a fifth coupling location and a sixth coupling location, wherein the sixth coupling location is coupled to the third coupling location of the second perforating gun section.

Clause 19, the assembly of clause 17 or 18, wherein the extended perforating gun assembly is disposed within a well in a top down fire configuration.

Clause 20, the assembly of at least one of clauses 17-19, wherein the extended perforating gun assembly is disposed within a well in a bottom up fire configuration.

While this specification provides specific details related to certain components related to a perforating gun assembly, it may be appreciated that the list of components is illustrative only and is not intended to be exhaustive or limited to the forms disclosed. Other components related to perforating casings within a wellbore will be apparent to those of ordinary skill in the art without departing from the scope and spirit of the disclosure. Further, the scope of the claims is intended to broadly cover the disclosed components and any such components that are apparent to those of ordinary skill in the art.

It should be apparent from the foregoing disclosure of illustrative embodiments that significant advantages have been provided. The illustrative embodiments are not limited solely to the descriptions and illustrations included herein and are instead capable of various changes and modifications without departing from the spirit of the disclosure.

What is claimed is:

1. A perforating gun assembly, comprising:

a housing;

at least one perforating charge disposed within the housing;

a detonating cord disposed within the housing and ballistically coupled to the at least one perforating charge;

a first coupling location and a second coupling location each configured to couple to an additional perforating gun assembly;

a detonator assembly disposed within the first coupling location, wherein a detonator of the detonator assembly is positioned to fire in a direction away from the detonating cord disposed within the housing, wherein the detonator assembly is individually addressable; and a ballistic bulkhead separating the detonating cord from the detonator.

2. The assembly of claim 1, wherein the detonator assembly comprises a detonator control board, and wherein the detonator control board is configured to receive a firing signal and control firing of the detonator.

3. The assembly of claim 1, wherein the detonator assembly is configured to detonate a second detonating cord of a second perforating gun assembly coupled to the perforating gun assembly.

4. The assembly of claim 1, comprising a booster coupled to the detonating cord adjacent to the second coupling location.

5. The assembly of claim 1, comprising a second detonator assembly disposed within the second coupling location.

6. The assembly of claim 5, wherein the second detonator assembly is disposed within a second perforating gun assembly.

7. The assembly of claim 1, wherein the at least one perforating charge is configured to punch holes in a casing of a wellbore.

8. The assembly of claim 1, wherein the detonator assembly is secured within the first coupling location using a threaded connection.

9. An extended perforating gun assembly, comprising:

a first perforating gun section, comprising:

a first housing;

a first set of one or more perforating charges disposed within the first housing;

a first detonating cord disposed within the first housing and ballistically coupled to the first set of the one or more perforating charges;

a first coupling location and a second coupling location;

a first detonator assembly disposed within the first coupling location, wherein a first detonator of the first detonator assembly is configured to detonate the first detonating cord; and a second detonator assembly disposed within the second coupling location, wherein a second detonator of the second detonator assembly is positioned to fire in a direction away from the first detonating cord disposed within the first housing, wherein the first detonator assembly and the second detonator assembly are individually addressable by control signals; and a ballistic bulkhead separating the second detonator from the first detonating cord; and a second perforating gun section, comprising:

a second housing;

a second set of the one or more perforating charges disposed within the second housing;

a second detonating cord disposed within the second housing and ballistically coupled to the second set of the one or more perforating charges, wherein the second detonator of the first perforating gun section is configured to detonate the second detonating cord; and a third coupling location and a fourth coupling location, wherein the third coupling location is coupled to the second coupling location of the first perforating gun section.

10. The assembly of claim 9, comprising a third detonator assembly disposed within the fourth coupling location of the second perforating gun section.

11. The assembly of claim 9, wherein the first detonator assembly is further downhole than the second detonator assembly when the extended perforating gun assembly is deployed within a wellbore.

12. The assembly of claim 9, wherein the first detonator assembly is further uphole than the second detonator assembly when the extended perforating gun assembly is deployed within a wellbore.

13. The assembly of claim 9, wherein the first detonator assembly is secured within the first coupling location and the second detonator assembly is secured within the second coupling location each using threaded connections.

14. An extended perforating gun assembly, comprising:

a first perforating gun section, comprising:

a first housing;

a first set of one or more perforating charges disposed within the first housing;

a first detonating cord disposed within the first housing and ballistically coupled to the first set of the one or more perforating charges;

a first coupling location and a second coupling location; and a first detonator assembly disposed within the first coupling location, wherein a first detonator of the first detonator assembly is positioned to fire in a direction away from the first detonating cord disposed within the first housing;

a ballistic bulkhead separating the first detonator from the first detonator cord; and a second perforating gun section, comprising:

a second housing;

a second set of the one or more perforating charges disposed within the second housing;

a second detonating cord disposed within the second housing and ballistically coupled to the second set of the one or more perforating charges, wherein the first detonator of the first detonator assembly is configured to detonate the second detonating cord;

a third coupling location and a fourth coupling location, wherein the fourth coupling location is coupled to the first coupling location of the first perforating gun section; and a second detonator assembly disposed within the third coupling location, wherein a second detonator of the second detonator assembly is positioned to fire in a direction away from the second detonating cord disposed within the second housing;

wherein the first detonator assembly and the second detonator assembly are individually addressable by control signals.

15. The assembly of claim 14, comprising:

a third perforating gun section, comprising:

a fifth coupling location and a sixth coupling location, wherein the sixth coupling location is coupled to the third coupling location of the second perforating gun section.

16. The assembly of claim 14, wherein the extended perforating gun assembly is disposed within a well in a top down fire configuration.

17. The assembly of claim 14, wherein the extended perforating gun assembly is disposed within a well in a bottom up fire configuration.

18. The assembly of claim 14, wherein the first detonator assembly is further downhole than the second detonator assembly when the extended perforating gun assembly is deployed within a wellbore.

19. The assembly of claim 14, wherein the first detonator assembly is further uphole than the second detonator assembly when the extended perforating gun assembly is deployed within a wellbore.

20. The assembly of claim 14, wherein the first detonator assembly is secured within the first coupling location and the second detonator assembly is secured within the second coupling location each using threaded connections.

* * * * *